US008758206B2

(12) United States Patent
Brown

(10) Patent No.: US 8,758,206 B2
(45) Date of Patent: Jun. 24, 2014

(54) SURFBOARD REPLICATING BALANCE BOARD SYSTEM

(75) Inventor: Armin Brown, Garden Grove, CA (US)

(73) Assignee: GoofBoard Products, LLC, Garden Grove, CA (US)

( * ) Notice: Subject to any disclaimer, the term of this patent is extended or adjusted under 35 U.S.C. 154(b) by 99 days.

(21) Appl. No.: 13/429,310

(22) Filed: Mar. 23, 2012

(65) Prior Publication Data

US 2013/0252792 A1 Sep. 26, 2013

(51) Int. Cl.
*A63B 22/14* (2006.01)

(52) U.S. Cl.
USPC ..... 482/146; 482/51; 434/247

(58) Field of Classification Search
USPC ..... 482/51, 146; 434/247
See application file for complete search history.

(56) References Cited

U.S. PATENT DOCUMENTS 3,863,915 A * 2/1975 Pifer ..... 482/51
4,601,469 A * 7/1986 Sasser, Jr. ..... 482/146
4,817,950 A * 4/1989 Goo ..... 463/36
4,966,364 A * 10/1990 Eggenberger ..... 482/146
5,062,629 A * 11/1991 Vaughan ..... 482/51
5,399,140 A * 3/1995 Klippel ..... 482/146
5,509,871 A * 4/1996 Giovanni ..... 482/51
5,545,115 A * 8/1996 Corcoran ..... 482/146
5,897,474 A * 4/1999 Romero ..... 482/146
6,017,297 A * 1/2000 Collins ..... 482/146
6,666,797 B1 * 12/2003 Martin ..... 482/51
6,916,276 B1 * 7/2005 Robinson ..... 482/51
7,479,097 B2 * 1/2009 Rosborough et al. ..... 482/146
7,488,177 B2 * 2/2009 Pearson ..... 434/247
2007/0184940 A1 * 8/2007 Tomes ..... 482/92
2012/0270193 A1 * 10/2012 Piercey ..... 434/247

* cited by examiner

*Primary Examiner* — Glenn Richman
(74) *Attorney, Agent, or Firm* — Mintz Levin Cohn Ferris Glovsky and Popeo, P.C.

(57) ABSTRACT

A balance board adapted for riding rail-to-rail, preferably so that at least a portion of a rider's feet will be placed on the board over the elongated tube. The balance board includes an elongated, planar board having a length that exceeds a width. The balance board further includes two pair of stops mounted to an underside of the board, each pair of stops being mounted near opposite ends of the board, and each stop of the pair of stops being mounted near opposite sides of the board. The balance board further includes a traction region between each stop of each pair of stop.

6 Claims, 1 Drawing Sheet

SURFBOARD REPLICATING BALANCE BOARD SYSTEM

BACKGROUND

This document relates to balance boards, and more particularly to a balance board system in which a board is balanced on a tube in parallel longitudinal axes.

Balance boards are used to develop fine motor skill and balance in humans. Balance boards typically include an elongated board having a length that is greater than a width, and a pivot mechanism. Usually the pivot mechanism is a cylinder that can roll by rotating about a central roll axis, which defines the pivot axis of the board. Most balance boards are adapted for balancing by a rider in which the board is positioned with its length latitudinal or transverse to the longitudinal or roll axis of the cylinder being, i.e. in a "see-saw" manner. In this manner, a rider's feet are positioned spaced apart on either side of the cylinder, and typically cannot be placed on the board directly above the cylinder.

SUMMARY

This document describes a balance board system having an elongated board that has a length greater than a width, and an elongated tube that has a length over five times greater than a diameter of the tube. The length of the board is positioned substantially parallel or longitudinal to a roll axis of the elongated tube, to provide a pivot axis of the elongated board that is parallel with the roll axis of the elongated tube.

In one aspect, a balance board includes an elongated, planar board having a length that exceeds a width. The balance board further includes two pair of stops mounted to an underside of the board, each pair of stops being mounted near opposite ends of the board, and each stop of the pair of stops being mounted near opposite sides of the board. The balance board further includes a traction region between each stop of each pair of stop.

In another aspect, a balance board system includes a rigid tube having a length, and an elongated, planar board having a width and a length that exceeds the width and which exceeds the length of the rigid tube. The elongated planar board includes two pair of stops mounted to an underside of the board, each pair of stops being mounted near opposite ends of the board, and each stop of the pair of stops being mounted near opposite sides of the board. The elongated, planar board further includes a traction region between each stop of each pair of stop, each traction region comprising a compressible layer of material applied on the bottom of the board.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figures 1A, 1B, 2:
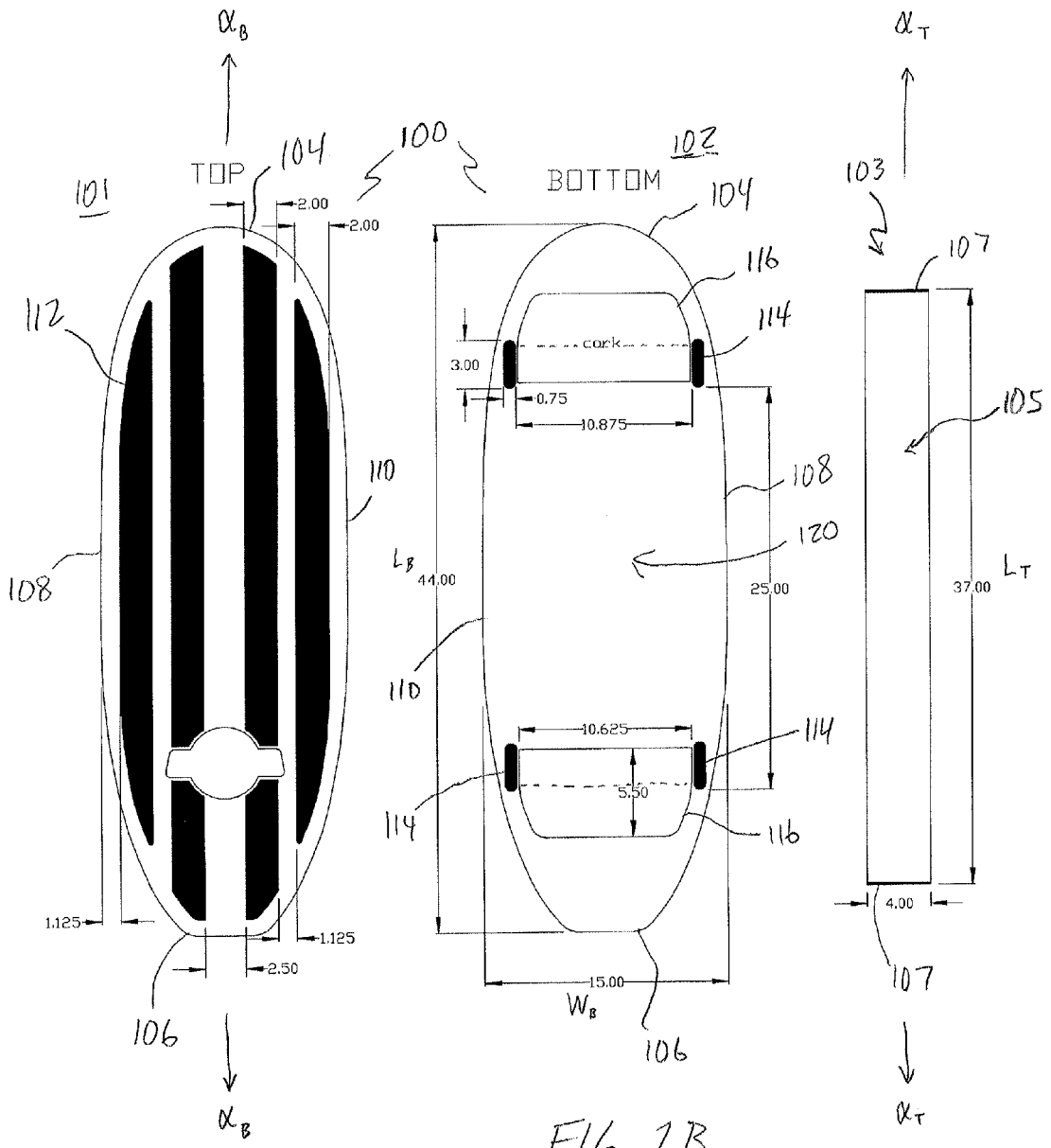
FIG. 1A illustrates a top of a board of a balance board system.
FIG. 1B illustrates a bottom of a board of a balance board system.
FIG. 2 illustrates a tube of a balance board system.

This document describes a balance board system that replicates the sensation and movement of a surfboard as it planes on water, particularly the lateral or side-to-side movement of the surfboard that is transverse a length of the surfboard.

The balance board system includes an elongated board and an elongated tube. The elongated board has a length that is greater than a width. The elongated tube has a length that is over five times greater than a diameter. The board is sized and adapted to be positioned substantially parallel or longitudinal to a roll axis of the elongated tube, to provide a pivot axis of the elongated board that is parallel with the roll axis of the elongated tube. In this manner, the board can be pivoted longitudinally over the tube by a rider, or ridden to roll the tube under the board to keep the board substantially level. Further, in preferred implementations, at least a portion of a rider's feet will be placed directly above the elongated tube. For example, in some implementations, a rider rocks back and forth laterally on the elongated board, in an axis lateral to the longitudinal axis of the board, while keeping his or her feet at least partially above the elongated tube.

The board includes traction regions extending transversely on a bottom of the board near both the nose and the tail of the board, such that both transverse compressible regions press on the tube. The traction regions are each formed of a compressible, flexible, deformable and/or elastic material such as cork or similar material, to provide traction between the transverse or lateral movement of the board and the tube as it rolls, or between a rolling movement of the board and the tube that is substantially stationary. Additionally, the traction regions provide dampening or cushioning to the interface with the tube for a smooth ride. A pair of stops extends down from the bottom of the board, one stop on each of opposite sides of each traction region, to inhibit lateral movement of the board relative the tube beyond the stops. A top of the board includes gripping regions to provide gripping between a rider's feet and the top of the board.

FIGS. 1A and 1B illustrate a respective top 101 and bottom 102 of a board 100 of a balance board system. The board 100 has a nose 104, a tail 106, a left side 108 and a right side 110. The nose 104 is preferably rounded or pointed, and the tail 106 is preferably truncated or flattened, such that the board 100 is asymmetric in a latitudinal axis that is transverse a longitudinal axis $\alpha_b$, to resemble a common surfboard aesthetic and to provide a rider with a sense of spatial direction when riding the board. The top 101 of the board 100 can also include a number of gripping regions 112. The gripping regions 112 can be formed of grip tape or similar surface. In some implementations, the gripping regions 112 are provided on the top 101 of the board 100 in a series of stripes, again to connote the common surfboard aesthetic, as well as provide suitable gripping surface coverage for a rider to be able to perform walks and tricks on the board 100.

The bottom 102 of the board 100 includes a traction region 116 formed on a surface of the bottom both near the nose 104 and near the tail 106 of the board. The traction regions 116 extend transversely across the bottom 102 of the board to opposing left and right sides 108, 110. Each traction region 116 is formed of a compressible, flexible, deformable and/or elastic material, to provide traction between the transverse or lateral movement of the board and the tube as it rolls, or between a rolling movement of the board and the tube when the tube is substantially stationary. In some implementations, each traction region 116 is formed of a thin layer of cork or other similar material. In these implementations, the layer of a cork is 0.5 to 5 mm thick or thicker, and preferably around 1.5 mm thick. Each traction region 116 can be a linear strip across the bottom 102 of the board 100, or, as illustrated in FIG. 1B, may extend forward and aft toward the respective nose 104 and tail 106 of the board, to provide greater traction and stability as the rider places his or her feet closer to the nose 104 or tail 106 of the board 100.

The bottom 102 of the board 100 further includes two or more pairs of stops 114. Each stop 114 of the pair of stops extend down from the bottom of the board, preferably near one of the nose 104 or tail 106, and one of the left side 108 and right side 110 of the bottom 102 of the board 100. In some implementations, the board 100 includes two pair of stops 114, each pair having one stop 114 proximate opposite sides or lateral ends of each traction region 116, to inhibit lateral movement of the board 100 relative the tube beyond the stops 114. Preferably, each stop 114 is mounted to the board 100 to extend from the bottom 102 at a small distance inset from the edge of the left and right sides 108, 110, so that a maximum width of the board 100 extends beyond the stops 114.

FIG. 2 illustrates a tube 103, having a cylindrical surface 105 that is capped at opposing distal ends 107. The tube 103 is preferably formed of a hard and rigid or semi-rigid material, such as dense cardboard, wood, plastic or carbon fiber, for example. In other implementations, the tube 103 can be formed of a material that provides limited flexibility. The tube 103 is formed to a length that is shorter than a length of a board 100, but long enough to mate against the traction regions 116 on the bottom 102 of the board 100. The board 100 and the tube 103 are adapted to be ridden on coincident longitudinal axes, $\alpha_b$ for the board 100, and $\alpha_t$ for the tube 103, as shown in FIGS. 1A and FIG. 2.

The board 100 is preferably made of a hard, rigid and resilient material, such as wood, wood-ply, bamboo, or other natural material. In some implementations, the board 100 can be formed to have limited flexibility in one or more axes. In yet other implementations, the board 100 can be made of plastic, poly-vinyl carbonate, carbon fiber, or the like. Preferably, the board 100 has a density sufficient to weigh on 103 tube on which it is ridden, yet allow a particular freedom of movement.

To be properly adapted for balancing parallel to a roll axis of the tube, the board 100 requires some specific dimensions. Further, in order to closely replicate a real surfboard's movement, it has been determined that the board 100 requires a particular shape and look, in addition to the specific dimensions. In some implementations, a board 100 has a width of between 10 and 20 inches, and a length of between 30 and 60 inches. A tube 103 has a diameter of between 2 and 6 inches, and a length of between 25 and 50 inches. In a particular exemplary implementation, the board 100 has a width of 15 inches and a length of 44 inches, and the tube has a diameter of 4 inches and a length of 37 inches. In this particular implementation, traction regions 116 of the board 100 are approximately 10.875 inches in width, and the stops are approximately 3 inches in length while extending 0.5 to 1 inch from the sides 108 and 110 of the board 100. This particular implementation has unexpected results of most closely replicating a rolling action of a real surfboard that planes on water, while allowing a rider to perform tricks such as walking, "hanging ten" or other surf-oriented maneuvers.

Although a few embodiments have been described in detail above, other modifications are possible. Other embodiments may be within the scope of the following claims.

The invention claimed is:

1. A balance board comprising:

an elongated, planar board having a top, a bottom, a nose, a tail, a left side rail and a right side rail, the elongated, planar board further having a length that exceeds a width;

a first pair of stops and a second pair of stops, the first pair of stops being mounted to the bottom of the elongated, planar board toward the nose and the second pair of stops being mounted to the bottom of the elongated, planar board toward the tail, one stop of each of the first and second pair of stops being mounted near the left side rail of the elongated, planar board, and the other stop of each of the first and second pair of stops being mounted near the left side rail of the elongated, planar board; and a first traction region and a second traction region applied to the bottom of the elongated, planar board between each stop of each of the first and second pair of stops, each of the first and second traction regions being formed of a layer of compressible material having a thickness of 0.5 to 5 millimeters.

2. A balance board in accordance with claim 1, further comprising one or more gripping regions on the top of the elongated, planar board, the one or more gripping regions adapted to provide gripping to a rider standing on the top of the elongated, planar board.

3. A balance board in accordance with claim 2, wherein the one or more gripping regions comprise a plurality of linear strips of grip tape provided along the length of the top of the elongated, planar board.

4. A balance board in accordance with claim 1, wherein the elongated, planar board is formed of wood.

5. A balance board system comprising:

a board having a planar top, a bottom, a nose, a tail, a left side rail and a right side rail, the board further having a length that exceeds a width;

a first pair of stops and a second pair of stops, the first pair of stops being mounted to the bottom of the elongated, planar board toward the nose and the second pair of stops being mounted to the bottom of the elongated, planar board toward the tail, one stop of each of the first and second pair of stops being mounted near the left side rail of the elongated, planar board, and the other stop of each of the first and second pair of stops being mounted near the left side rail of the elongated, planar board;

a first traction region and a second traction region applied to the bottom of the elongated, planar board between each stop of each of the first and second pair of stops, each traction region comprising a layer of compressible material applied on the bottom of the board and having a thickness of 0.5 to 5 millimeters; and a rigid tube on which the board is balanced, the rigid tube having a length to contact both the first and second traction regions on the bottom of the board.

6. A balance board system comprising:

a rigid tube having a length along a longitudinal axis; and a board for being balanced by a rider on the rigid tube where a length of the board is placed in parallel to the longitudinal axis of the rigid tube, the board comprising:

a top, a bottom, a nose, a tail, a left side rail and a right side rail, the board further having a length from the nose to the tail that exceeds a width from the left side rail to the right side rail;

a first pair of stops and a second pair of stops, the first pair of stops being mounted to the bottom of the board toward the nose and the second pair of stops being mounted to the bottom of the board toward the tail, one stop of each of the first and second pair of stops being mounted near the left side rail of the board, and the other stop of each of the first and second pair of stops being mounted near the left side rail of the board, each of the stops of the first and second pair of stops extending less than one inch from the bottom of the board, the first and second pair of stops confining a lateral movement of the rigid tube relative to the bottom of the board; and a first traction region and a second traction region, each of the first and second traction regions being formed of a layer of compressible material having a thickness of 0.02 to 0.2 inches and being applied to the bottom of the board between each stop of each of the first and second pair of stops to provide traction to the lateral movement of the rigid tube.

* * * * *